US009371655B1

(12) United States Patent
Davis et al.

(10) Patent No.: US 9,371,655 B1
(45) Date of Patent: Jun. 21, 2016

(54) DOLLY APPARATUS FOR DOOR INSTALLATION

(71) Applicants: Christopher L. Davis, Hampton, VA (US); Faye E. Davis, Hampton, VA (US)

(72) Inventors: Christopher L. Davis, Hampton, VA (US); Faye E. Davis, Hampton, VA (US)

( * ) Notice: Subject to any disclaimer, the term of this patent is extended or adjusted under 35 U.S.C. 154(b) by 258 days.

(21) Appl. No.: 14/146,784

(22) Filed: Jan. 3, 2014

(51) Int. Cl.
*E04G 21/14* (2006.01)
*E04F 21/00* (2006.01)

(52) U.S. Cl.
CPC ..... *E04F 21/0007* (2013.01)

(58) Field of Classification Search
CPC ..... E04F 21/0007; B60B 29/002; B62B 1/14; B62B 1/10; B62B 3/12; B62B 2203/44; B62B 1/268; B62B 3/108; B60P 1/6445; B60P 1/64; B60P 1/52
USPC ..... 414/10, 11, 426, 428, 455, 458, 684.3; 280/79.7, 47.131; 269/17
See application file for complete search history.

(56) References Cited

U.S. PATENT DOCUMENTS 2,967,627 A 1/1961 Vinson
3,223,199 A * 12/1965 Schwehr ..... B66B 9/187 187/241
3,458,057 A * 7/1969 Stefan ..... B25B 11/00 269/55
4,050,671 A * 9/1977 Coleman ..... B66F 3/08 254/7 R
4,278,244 A * 7/1981 Carter ..... B25B 5/142 269/152
4,978,132 A 12/1990 Wilson et al.
5,279,432 A * 1/1994 Pryor ..... B61G 7/00 213/111
5,711,429 A * 1/1998 Brown ..... B65D 85/48 211/189
6,530,740 B2 * 3/2003 Kim ..... B62B 1/002 180/251
7,014,413 B2 * 3/2006 Young ..... B62B 3/108 269/905
7,325,817 B1 * 2/2008 Jankowski ..... B62B 3/108 254/2 R
7,780,389 B1 * 8/2010 Young ..... B62B 3/022 280/43.22
D639,523 S 6/2011 Smith
2007/0020071 A1 1/2007 Williams
2008/0014052 A1 * 1/2008 Rodriguez ..... B66F 9/07568 414/11

* cited by examiner

*Primary Examiner* — Michael McCullough
*Assistant Examiner* — Lynn Schwenning

(57) ABSTRACT

A dolly apparatus for door installation transports and facilitates the installation of multiple doors. The apparatus includes a frame. A plurality of wheels is coupled to and extends rearwardly from the frame. A support bracket is coupled to the frame and is configured to support a door thereon. A first guide member is coupled to and extends forwardly from the frame. The first guide member forms a first slot configured to receive a non-hinged side of the door therein. A pair of arms is coupled to the frame. The arms are positioned in spaced parallel relationship relative to each other and extend forwardly from the frame. A plurality of casters is provided and each is configured to contact a ground surface. One of the casters is coupled a first one of the arms. One of the casters is coupled to a second one of the arms.

15 Claims, 5 Drawing Sheets

DOLLY APPARATUS FOR DOOR INSTALLATION

BACKGROUND OF THE DISCLOSURE

Field of the Disclosure

The disclosure relates to dolly devices and more particularly pertains to a new dolly device for transporting and facilitating the installation of multiple doors.

SUMMARY OF THE DISCLOSURE

An embodiment of the disclosure meets the needs presented above by generally comprising a frame. A plurality of wheels is coupled to and extends rearwardly from the frame. A support bracket is coupled to the frame and is configured to support a door thereon. A first guide member is coupled to and extends forwardly from the frame. The first guide member forms a first slot configured to receive a non-hinged side of the door therein. A pair of arms is coupled to the frame. The arms are positioned in spaced parallel relationship relative to each other and extend forwardly from the frame. A plurality of casters is provided and each is configured to contact a ground surface. One of the casters is coupled a first one of the arms. One of the casters is coupled to a second one of the arms.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
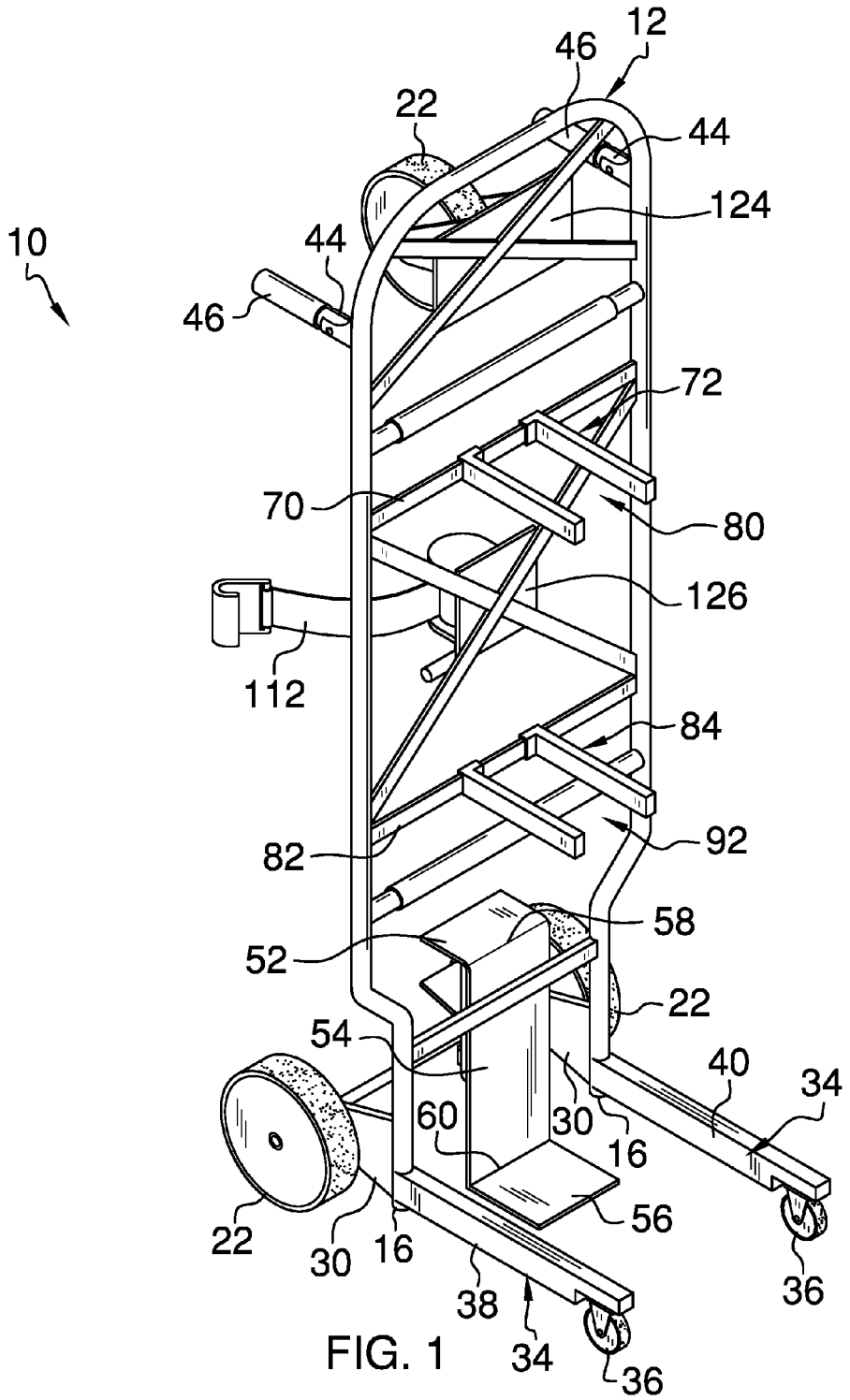
FIG. 1 is a top front side perspective view of a dolly apparatus for door installation according to an embodiment of the disclosure.
Figure 2:
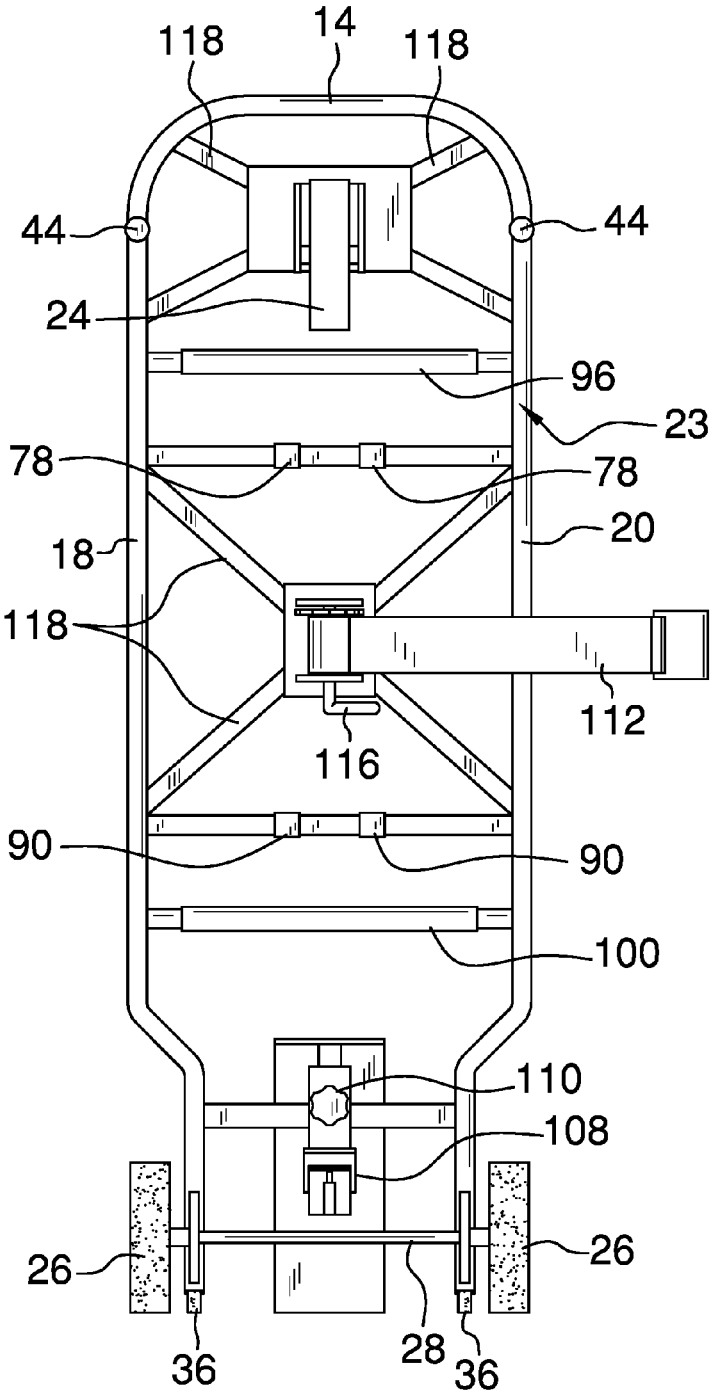
FIG. 2 is a back view of an embodiment of the disclosure.
Figure 3:
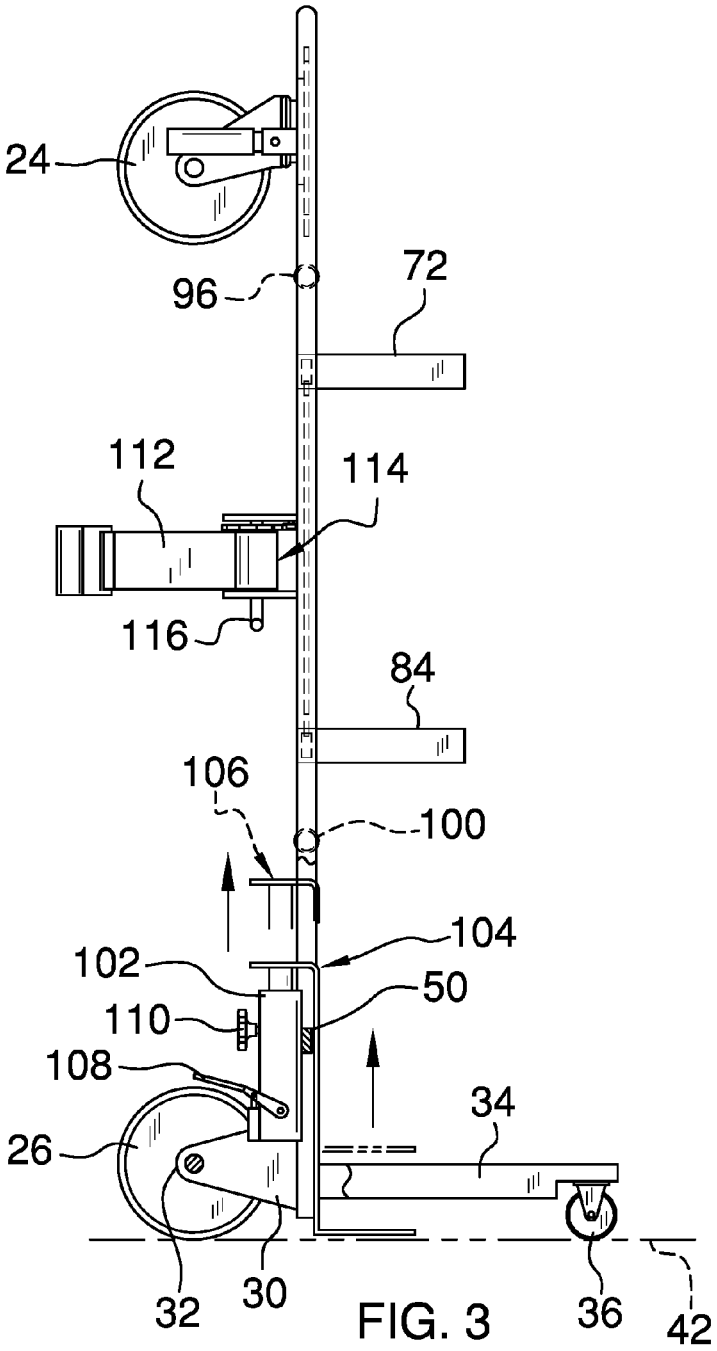
FIG. 3 is a side view of an embodiment of the disclosure.
Figure 4:
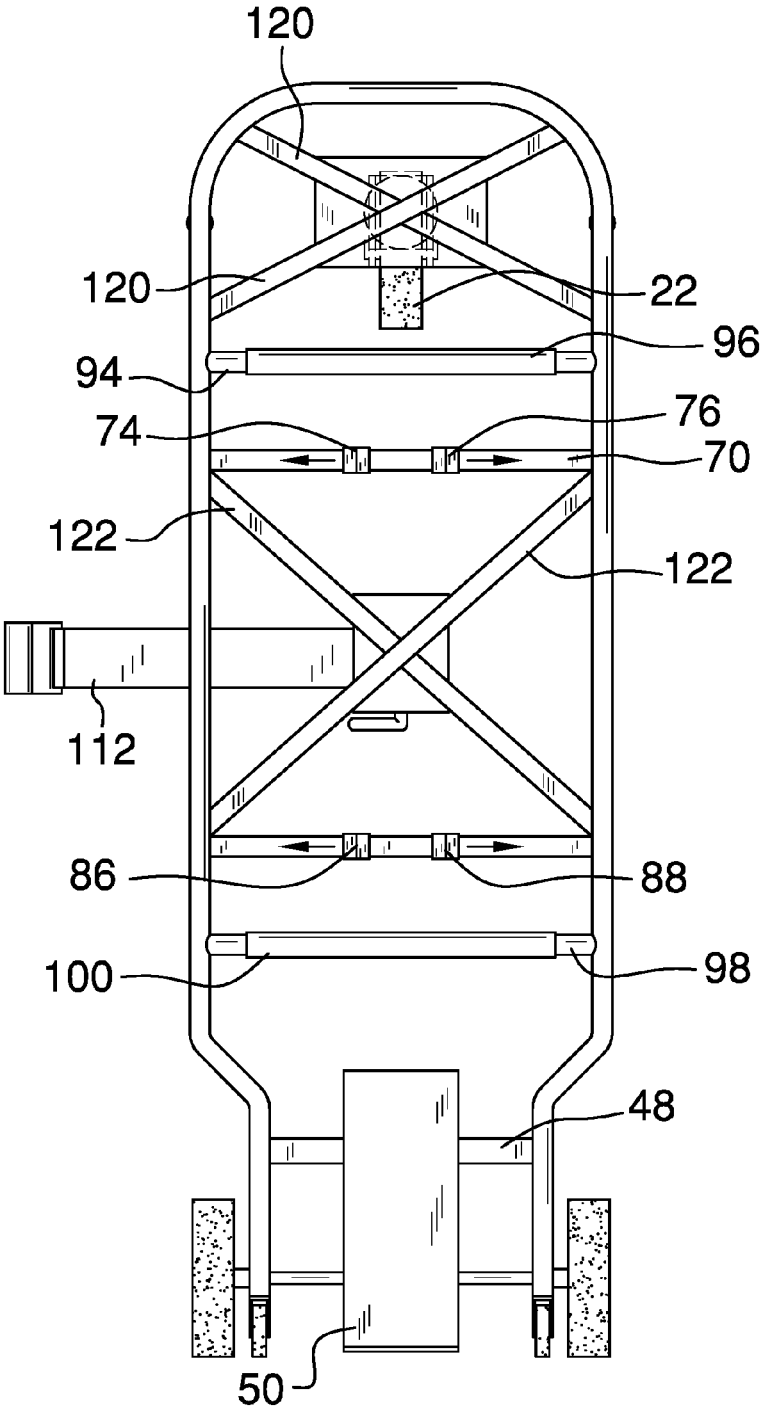
FIG. 4 is a front view of an embodiment of the disclosure.
Figure 5:
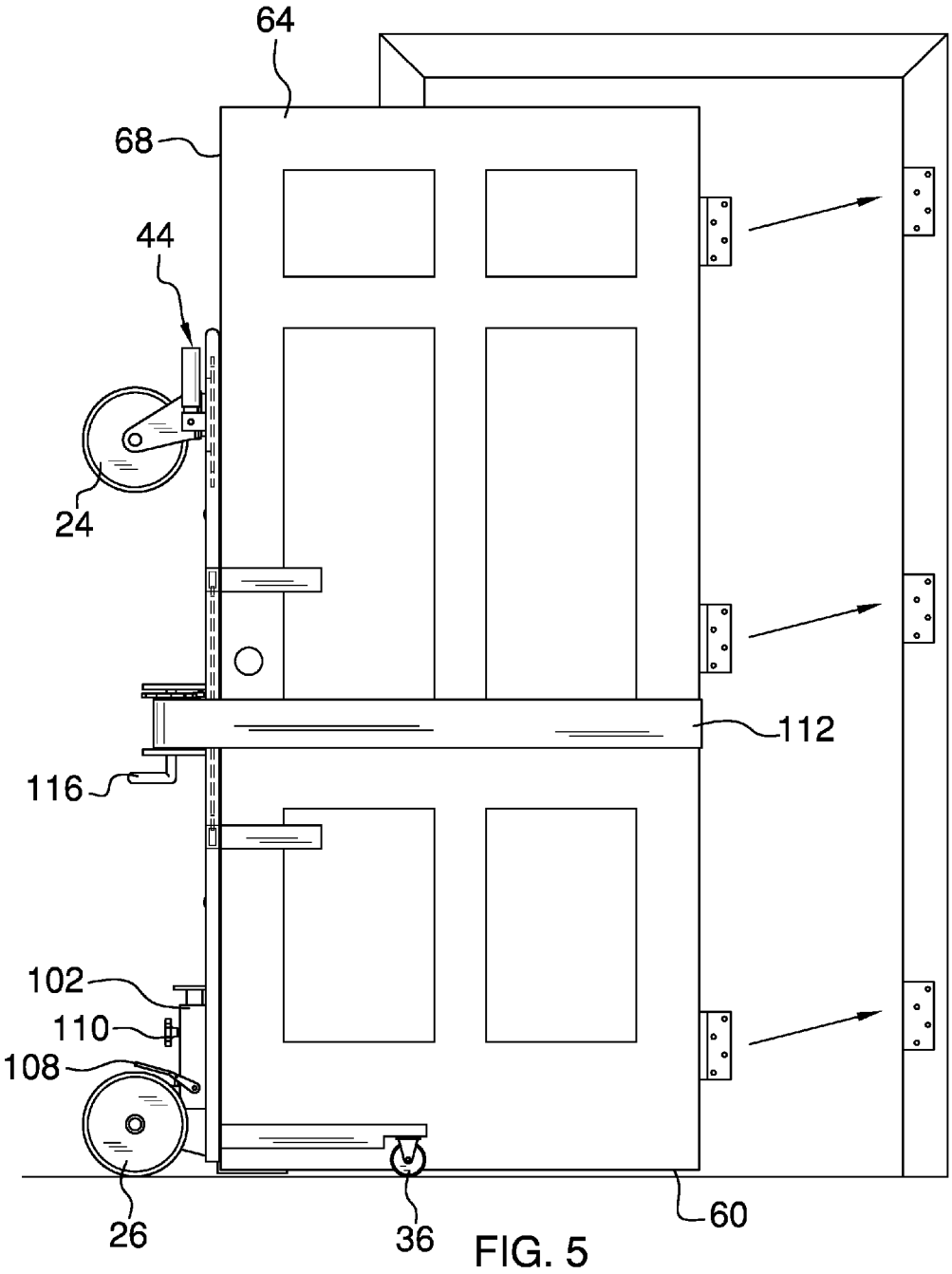
FIG. 5 is an in-use side view of an embodiment of the disclosure.

With reference now to the drawings, and in particular to FIGS. 1 through 5 thereof, a new dolly device embodying the principles and concepts of an embodiment of the disclosure and generally designated by the reference numeral 10 will be described.

As best illustrated in FIGS. 1 through 5, the dolly apparatus for door installation 10 generally comprises a frame 12 having a top section 14, a bottom section 16, a first lateral side section 18 and a second lateral side section 20. The first 18 and second 20 lateral side sections are coupled to and extend between the top section 14 and the bottom section 16. The frame 12 may be tubular.

A plurality of wheels 22 is coupled to the frame 12. Each of the wheels 22 is coupled to a back surface 23 of the frame 12 wherein the wheels 22 extend rearwardly of the frame 12. The plurality of wheels 22 comprise a front wheel 24 positioned proximate the top section 14 and a pair of rear wheels 26 positioned proximate the bottom section 16. The front wheel 24 is swivelable relative to the frame 12, while each of the rear wheels 26 is fixed in position relative to the frame 12. An axle 28 is coupled to and extends between the rear wheels 26. A pair of supports 30 is coupled to and extends rearwardly of the frame 12. Each of the supports 30 has a distal end 32 relative to the frame 12 wherein the distal end 32 of each of the supports 30 is coupled to and positioned between the axle 28 and an associated one of the rear wheels 26.

A pair of arms 34 is coupled to the frame 12 proximate the bottom section 16 of the frame 12. The arms 34 are positioned in spaced parallel relationship relative to each other. The arms 34 extend forwardly from the frame 12 in a direction opposite of the wheels 22. Each of the arms 34 and the frame 12 are constructed from a rigid metal, such as metal or the like. A plurality of casters 36 is provided. One of the casters 36 is coupled to a first one 38 of the arms 34. One of the casters 36 is coupled to a second one 40 of the arms 34. Each of the casters 36 is configured to contact a ground surface 42 to facilitate movement of the apparatus 10 on the ground surface 42.

A pair of handles 44 is coupled to the frame 12. Each of the handles 44 is pivotally coupled to the frame 12 wherein the handles 44 are selectively pivotable between an extended position and a retracted position. Each of the handles 44 is offset from the casters 36 wherein manipulation of the handles 44 pivots the frame 12 toward the casters 36 and is configured to lift the front wheel 22 off of the ground surface 42. A pair of grips 46 is provided. Each of the handles 44 has an associated one of the grips 46 positioned thereon.

A crossbar 48 is coupled to and extends between the first lateral side section 18 and the second lateral side section 20 of the frame 12. The crossbar 48 is positioned proximate the bottom section 16 of the frame 12. A support bracket 50 is coupled to the crossbar 48. The support bracket 50 has a first flange 52, a second flange 54 and a third flange 56. The first flange 52 is coupled to and extends outwardly from a top end 58 of the second flange 54. The third flange 56 is coupled to and extends outwardly from a bottom end 60 of the second flange 54. Each of the first flange 52 and the third flange 56 is positioned transversely relative to the second flange 54. The first flange 52 extends outwardly from the frame 12 in a same direction as each of the wheels 22. The third flange 56 extends outwardly from the frame 12 in a direction opposite of the wheels 22. The support bracket 50 is configured to support a door 64 thereon wherein the third flange 56 is configured to abut a lower end 66 of the door 64 and the second flange 54 is configured to abut a non-hinged side 68 of the door 64.

A first support bar 70 is coupled to and extends between the first lateral side section 18 and the second lateral side section 20. A first guide member 72 is coupled to and extends forwardly away from the first support bar 70 in a direction opposite of the wheels 22. The first guide member 72 includes a first retaining bracket 74 and a second retaining bracket 76. Each of the first 74 and second 76 retaining brackets of the first guide member 72 has a first end 78 slidably coupled to the first support bar 70 wherein the first 74 and second 76 retaining brackets of the first guide member 72 are slidable relative to each other to position the first 74 and second 76 retaining brackets of the first guide member 72 at a selectable distance relative to each other. The first guide member 72 forms a first slot 80 between the first 74 and second 76 retaining brackets of the first guide member 72 wherein the first slot 80 is configured to receive the non-hinged side 68 of the door 64 therein.

Similarly, a second support bar 82 is coupled to and extends between the first lateral side section 18 and the second lateral side section 20. The second support bar 82 is positioned in spaced parallel relationship relative to the first support bar 70. A second guide member 84 is coupled to and extends forwardly away from the second support bar 82 in a direction opposite of the wheels 22. The second guide member 84 includes a first retaining bracket 86 and a second retaining bracket 88. Each of the first 86 and second 88 retaining brackets of the second guide member 84 has a first end 90 slidably coupled to the second support bar 82 wherein the first 86 and second 88 retaining brackets of the second guide member 84 are slidable relative to each other to position the first 86 and second 88 retaining brackets of the second guide member 84 at a selectable distance relative to each other. The second guide member 84 forms a second slot 92 between the first 86 and second 88 retaining brackets of the second guide member 84 wherein the second slot 92 is configured to receive the non-hinged side 68 of the door 64 therein. Each of the first 72 and second 84 guide members may have a coating positioned thereon to help prevent damage to the door 64.

A first cross member 94 is coupled to and extends between the first lateral side section 18 and the second lateral side section 20. The first cross member 94 is aligned with and positioned adjacent to the first support bar 70. A first roller 96 is coupled to and extends around the first cross member 94. A second cross member 98 is coupled to and extends between the first lateral side section 18 and the second lateral side section 20. The second cross member 98 is aligned with and positioned adjacent to the second support bar 82. A second roller 100 is coupled to and extends around the second cross member 98.

A jack 102 is coupled to the support bracket 50. The jack 102 is mechanically coupled to the support bracket 50 wherein the jack 102 is configured to lift the support bracket 50 from a starting position 104 adjacent to the ground surface 42 to an elevated position 106 above the ground surface 42. The jack 102 is configured for positioning the door 64 at a selectable height relative to the ground surface 42. The jack 102 is conventional and may use hydraulic power to lift the support bracket 50 above the starting position 104. A pedal 108 is operationally coupled to the jack 102 for selectively elevating the support bracket 50 above the ground surface 42. A release knob 110 is coupled to the jack 102. The release knob 110 is operationally coupled to the jack 102 wherein manipulation of the release knob 110 releases pressure within the jack 102 and lowers the support bracket 50 to the starting position 104.

A ratchet strap 112 is coupled to the frame 12. The ratchet strap 112 is configured to be wrapped around and configured to secure the door 64 to the frame 12. A ratchet spool 114 is coupled to the frame 12. The ratchet spool 114 stores the ratchet strap 112 in a coiled manner on the ratchet spool 114. A ratchet handle 116 is coupled to the ratchet spool 114. The ratchet handle 116 is mechanically coupled to the ratchet spool 114 wherein manipulation of the ratchet handle 116 rotates the ratchet strap 112 about the ratchet spool 114.

A plurality of brace members 118 is coupled to the frame 12. Each of the brace members 118 extends between the first lateral side section 18 and the second lateral side section 20 and each is intended to provide reinforcement to the frame 12. The brace members 118 include an upper pair 120 of brace members 118 positioned proximate the top section 14 and a lower pair 122 of brace members 118 positioned proximate the bottom section 16. The brace members 118 of the upper pair 120 of brace members 118 intersect each other. Similarly, the brace members 118 of the lower pair 122 of brace members 118 intersect each other. An upper support panel 124 is coupled to the frame 12 and is positioned between the upper pair 120 of brace members 118 and the front wheel 24. A lower support panel 126 is coupled to the frame 12 and is positioned between the lower pair 122 of brace members 118 and the ratchet spool 114.

In use, as stated above and shown in the Figures, all of the wheels 22 are positioned on ground surface 42. Up to three doors 64 are then simultaneously placed within the first 72 and second 84 guide members and positioned on the support bracket 50 as described above. The first 72 and second 84 guide members can be slid along the first 70 and second 82 support bars so that they securely hold the doors 64 in position on the support bracket 50. Hinges can then be installed on the door 64. The ratchet strap 112 is secured around the door 64 to help retain the door 64 on the frame 12. The handles 44 are then manipulated to pivot the frame 12 toward the casters 36 such that the front wheel 22 is lifted off the ground surface 42. The pedal 108 is used to elevate the door 64 to a desired height above the ground surface 42 to align the hinges on the door 64 with holes in a door frame. Conventional fasteners, such as screws or the like, are then used to install the door 64 to the door frame. The ratchet strap 112 is removed from the door 64 and the release knob 110 is manipulated to lower the support bracket 50 to the starting position 104. In this manner, the apparatus 10 permits a single person to easily transport and install doors 64 without any outside assistance and thus helps to decrease labor costs and injuries.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A dolly apparatus for door installation comprising:

a frame, said frame being tubular and including a top section, a bottom section, a first lateral side section and a second lateral side section, said first and second lateral side sections being coupled to and extending between said top section and said bottom section;

a plurality of wheels coupled to and extending rearwardly from said frame, said plurality of wheels comprising a front wheel positioned proximate said top section and a pair of rear wheels positioned proximate said bottom section, said front wheel being swivelable relative to said frame, each of said rear wheels being fixed relative to said frame;

a support bracket coupled to said frame, said support bracket being configured to support a door thereon;

a first guide member coupled to and extending forwardly from said frame, said first guide member forming a first slot configured to receive a non-hinged side of the door therein;

a pair of arms coupled to said frame, said arms being positioned in spaced parallel relationship relative to each other, said arms extending forwardly from said frame;

a plurality of casters, one of said casters being coupled to a first one of said arms, one of said casters being coupled to a second one of said arms, each of said casters being configured to support said apparatus on a ground surface;

a first support bar coupled to and extending between said first lateral side section and said second lateral side section, said first guide member being coupled to and extending forwardly away from said first support bar;

a first cross member coupled to and extending between said first lateral side section and said second lateral side section, said first cross member being aligned with and positioned adjacent to said first support bar;

a first roller coupled to and extending around said first cross member; and a ratchet strap coupled to said frame, said ratchet strap being configured to be wrapped around and configured to secure the door to said frame.

2. The apparatus of claim 1, further comprising a crossbar coupled to and extending between said first lateral side section and said second lateral side section of said frame, said crossbar being positioned proximate said bottom section of said frame.

3. The apparatus of claim 1, further comprising said support bracket having a first flange, a second flange and a third flange, said first flange being coupled to and extending outwardly from a top end of said second flange, said third flange being coupled to and extending outwardly from a bottom end of said second flange in a direction opposite of said wheels, said third flange being configured to abut a lower end of the door and said second flange being configured to abut the non-hinged side of the door.

4. The apparatus of claim 1, further comprising a pair of handles coupled to said frame, each of said handles being pivotally coupled to said frame wherein said handles are selectively pivotable between an extended position and a retracted position, each of said handles being offset from said casters wherein manipulation of said handles pivots said frame toward said casters and is configured to lift said front wheel off of the ground surface.

5. The apparatus of claim 1, further comprising said first guide member including a first retaining bracket and a second retaining bracket, each of said first and second retaining brackets of said first guide member having a first end slidably coupled to said first support bar wherein said first and second retaining brackets of said first guide member are slidable relative to each other to position said first and second retaining brackets of said first guide member at a selectable distance relative to each other.

6. The apparatus of claim 1, further comprising:

a second support bar coupled to and extending between said first lateral side section and said second lateral side section, said second support bar being positioned in spaced parallel relationship relative to said first support bar; and a second guide member coupled to and extending forwardly away from said second support bar in a direction opposite of said wheels, said second guide member forming a second slot configured to receive the non-hinged side of the door therein.

7. The apparatus of claim 6, further comprising said second guide member including a first retaining bracket and a second retaining bracket, each of said first and second retaining brackets of said second guide member having a first end slidably coupled to said second support bar wherein said first and second retaining brackets of said second guide member are slidable relative to each other to position said first and second retaining brackets of said second guide member at a selectable distance relative to each other.

8. The apparatus of claim 6, further comprising:

a second cross member coupled to and extending between said first lateral side section and said second lateral side section, said second cross member being aligned with and positioned adjacent to said second support bar; and a second roller coupled to and extending around said second cross member.

9. The apparatus of claim 1, further comprising a jack coupled to said support bracket, said jack being mechanically coupled to said support bracket wherein said jack is configured to lift said support bracket from a starting position adjacent to the ground surface to an elevated position above the ground surface, said jack being configured for positioning the door at a selectable height relative to the ground surface.

10. The apparatus of claim 1, further comprising a ratchet spool coupled to said frame, said ratchet spool storing said ratchet strap in a coiled manner on said ratchet spool.

11. The apparatus of claim 10, further comprising a ratchet handle coupled to said ratchet spool, said ratchet handle being mechanically coupled to said ratchet spool wherein manipulation of said ratchet handle rotates said ratchet strap about said ratchet spool.

12. The apparatus of claim 10, further comprising:

a plurality of brace members coupled to said frame; and a lower support panel coupled to said frame and being positioned between said brace members and said ratchet spool.

13. The apparatus of claim 1, further comprising a plurality of brace members coupled to said frame, each of said brace members extending between said first lateral side section and said second lateral side section.

14. The apparatus of claim 1, further comprising:

a plurality of brace members coupled to said frame; and an upper support panel coupled to said frame and being positioned between said brace members and said front wheel.

15. A dolly apparatus for door installation comprising:

a frame having a top section, a bottom section, a first lateral side section and a second lateral side section, said first and second lateral side sections being coupled to and extending between said top section and said bottom section, said frame being tubular;

a plurality of wheels coupled to said frame, each of said wheels being coupled to a back surface of said frame wherein said wheels extend rearwardly of said frame, said plurality of wheels comprising a front wheel positioned proximate said top section and a pair of rear wheels positioned proximate said bottom section, said front wheel being swivelable relative to said frame, each of said rear wheels being fixed relative to said frame;

an axle coupled to and extending between said rear wheels;

a pair of supports coupled to and extending rearwardly of said frame, each of said supports having a distal end relative to said frame wherein said distal end of each of said supports is coupled to and positioned between said axle and an associated one of said rear wheels;

a pair of arms coupled to said frame proximate said bottom section of said frame, said arms being positioned in spaced parallel relationship relative to each other, said arms extending forwardly from said frame in a direction opposite of said wheels;

a plurality of casters, one of said casters being coupled to a first one of said arms, one of said casters being coupled to a second one of said arms, each of said casters being configured to contact a ground surface to facilitate movement of said apparatus on the ground surface;

a pair of handles coupled to said frame, each of said handles being pivotally coupled to said frame wherein said handles are selectively pivotable between an extended position and a retracted position, each of said handles being offset from said casters wherein manipulation of said handles pivots said frame toward said casters and is configured to lift said front wheel off of the ground surface;

a pair of grips, each of said handles having an associated one of said grips positioned thereon;

a crossbar coupled to and extending between said first lateral side section and said second lateral side section of said frame, said crossbar being positioned proximate said bottom section of said frame;

a support bracket coupled to said crossbar, said support bracket having a first flange, a second flange and a third flange, said first flange being coupled to and extending outwardly from a top end of said second flange, said third flange being coupled to and extending outwardly from a bottom end of said second flange, each of said first flange and said third flange being positioned transversely relative to said second flange, said first flange extending outwardly from said frame in a same direction as each of said wheels, said third flange extending outwardly from said frame in a direction opposite of said wheels, said support bracket being configured to support a door thereon wherein said third flange is configured to abut a lower end of the door and said second flange is configured to abut a non-hinged side of the door;

a first support bar coupled to and extending between said first lateral side section and said second lateral side section;

a first guide member coupled to and extending forwardly away from said first support bar in a direction opposite of said wheels, said first guide member including a first retaining bracket and a second retaining bracket, each of said first and second retaining brackets of said first guide member having a first end slidably coupled to said first support bar wherein said first and second retaining brackets of said first guide member are slidable relative to each other to position said first and second retaining brackets of said first guide member at a selectable distance relative to each other, said first guide member forming a first slot between said first and second retaining brackets of said first guide member wherein said first slot is configured to receive the non-hinged side of the door therein;

a second support bar coupled to and extending between said first lateral side section and said second lateral side section, said second support bar being positioned in spaced parallel relationship relative to said first support bar;

a second guide member coupled to and extending forwardly away from said second support bar in a direction opposite of said wheels, said second guide member including a first retaining bracket and a second retaining bracket, each of said first and second retaining brackets of said second guide member having a first end slidably coupled to said second support bar wherein said first and second retaining brackets of said second guide member are slidable relative to each other to position said first and second retaining brackets of said second guide member at a selectable distance relative to each other, said second guide member forming a second slot between said first and second retaining brackets of said second guide member wherein said second slot is configured to receive the non-hinged side of the door therein;

a first cross member coupled to and extending between said first lateral side section and said second lateral side section, said first cross member being aligned with and positioned adjacent to said first support bar;

a first roller coupled to and extending around said first cross member;

a second cross member coupled to and extending between said first lateral side section and said second lateral side section, said second cross member being aligned with and positioned adjacent to said second support bar;

a second roller coupled to and extending around said second cross member;

a jack coupled to said support bracket, said jack being mechanically coupled to said support bracket wherein said jack is configured to lift said support bracket from a starting position adjacent to the ground surface to an elevated position above the ground surface, said jack being configured for positioning the door at a selectable height relative to the ground surface, said jack using hydraulic power to lift said support bracket above the starting position;

a pedal operationally coupled to said jack for selectively elevating said support bracket above the ground surface;

a release knob coupled to said jack, said release knob being operationally coupled to said jack wherein manipulation of said release knob releases pressure within said jack and lowers said support bracket to the starting position;

a ratchet strap coupled to said frame, said ratchet strap being configured to be wrapped around and configured to secure the door to said frame;

a ratchet spool coupled to said frame, said ratchet spool storing said ratchet strap in a coiled manner on said ratchet spool;

a ratchet handle coupled to said ratchet spool, said ratchet handle being mechanically coupled to said ratchet spool wherein manipulation of said ratchet handle rotates said ratchet strap about said ratchet spool;

a plurality of brace members coupled to said frame, each of said brace members extending between said first lateral side section and said second lateral side section, said brace members including an upper pair of brace members positioned proximate said top section and a lower pair of brace members positioned proximate said bottom section, said brace members of said upper pair of brace members intersecting each other, said brace members of said lower pair of brace members intersecting each other;

an upper support panel coupled to said frame and being positioned between said upper pair of brace members and said front wheel; and a lower support panel coupled to said frame and being positioned between said lower pair of brace members and said ratchet spool.

* * * * *